US006857259B2

(12) United States Patent
Wortmann

(10) Patent No.: US 6,857,259 B2
(45) Date of Patent: Feb. 22, 2005

(54) TEXTURING MACHINE AND METHOD OF THREADING AN ADVANCING YARN

(75) Inventor: Thomas Wortmann, Wuppertal (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/406,361

(22) Filed: Apr. 3, 2003

(65) Prior Publication Data

US 2003/0167748 A1 Sep. 11, 2003

Related U.S. Application Data

(63) Continuation of application No. PCT/EP01/12318, filed on Oct. 25, 2001.

(30) Foreign Application Priority Data

Nov. 9, 2000 (DE) ..... 100 55 393

(51) Int. Cl.[7] ..... D01H 13/04
(52) U.S. Cl. ..... 57/280; 226/91
(58) Field of Search ..... 57/261, 263, 279, 57/280; 28/202; 226/91, 92; 242/474.2

(56) References Cited

U.S. PATENT DOCUMENTS 2,491,569 A * 12/1949 Lichtenberg ..... 57/279
2,855,749 A * 10/1958 Jan ..... 57/279
3,396,442 A * 8/1968 Gilmore ..... 28/272
3,559,255 A * 2/1971 Cockroft ..... 432/59
4,277,867 A 7/1981 Lucke
4,351,492 A * 9/1982 Aoyama et al. ..... 242/476.1
4,817,880 A * 4/1989 Lenk et al. ..... 242/366
5,111,648 A 5/1992 Isoard
5,119,996 A * 6/1992 Stahlecker ..... 242/472.8
5,351,535 A * 10/1994 Etter et al. ..... 73/160
5,896,976 A * 4/1999 Jaschke ..... 57/352
5,924,272 A * 7/1999 Jaschke et al. ..... 57/279
6,209,302 B1 * 4/2001 Wortmann et al. ..... 57/290

FOREIGN PATENT DOCUMENTS

| | | |
|---|---|---|
| DE | 36 23 370 A1 | 1/1987 |
| DE | 101 17 087 A1 | 10/2001 |
| EP | 0 591 825 A1 | 4/1994 |
| JP | 60015361 | 1/1985 |

* cited by examiner

*Primary Examiner*—Danny Worrell
*Assistant Examiner*—Shaun R Hurley
(74) *Attorney, Agent, or Firm*—Alston & Bird LLP

(57) ABSTRACT

A texturing machine for crimping an advancing yarn and which includes a plurality of processing units and a plurality of feed systems. At least one of the feed systems is formed by a driven feed roll and a rotatable guide roll mounted in cantilever fashion on a machine frame, and about which the yarn is looped. A threading device is associated with the rolls for an initial threadup of the yarn before the start of the process, and by which it is possible to lay the advancing yarn against the circumference of the rolls with a total looping greater than 360°.

17 Claims, 6 Drawing Sheets

TEXTURING MACHINE AND METHOD OF THREADING AN ADVANCING YARN

CROSS REFERENCE TO RELATED APPLICATION

This is a continuation of international application Serial No. PCT/EP01/12318, filed 25 Oct. 2001, and which was not published in English. The disclosure of the referenced application is incorporated herein by reference.

BACKGROUND OF THE INVENTION

The invention relates to a texturing machine for crimping yarns, as well as to a method of threading an advancing yarn onto a feed system of the machine which comprises two rotatable rolls mounted in cantilever fashion.

A texturing machine of the above described type is known from DE 36 23 370. Such texturing machines are used for producing on the one hand a crimped bulk yarn from a flat thermoplastic multifilament yarn, and on the other hand for drawing the yarn, so that the crimped yarn exhibits an adequate strength for further processing. To generate a drawing tension, it is common to use, for example, feed systems, which comprise a feed roll with an associated guide roll. Over these rolls, the yarn advances in several loopings. With that, it is possible to produce particularly high draw forces. On the other hand, feed systems of this type require a threadup procedure, which can be performed by an operator before the start of the process, for purposes of enabling a multiple looping of the yarn. In this connection, it must be ensured that the advancing yarn and the leaving yarn extend in separate planes, so as to avoid having adjacent yarn lengths intertwine on the circumference of the rolls during the threading process.

It is an object of the invention to further develop a texturing machine of the initially described type such that it is possible to thread the yarn before the start of the process, independently of an operator, in a highly reliable and reproducible manner, in feed systems comprising a feed roll and a guide roll.

SUMMARY OF THE INVENTION

The above and other objects and advantages of the invention are achieved by the provision of a yarn texturing machine which comprises a plurality of processing units, and a plurality of yarn feed systems for serially advancing a yarn along a path of travel through the units. At least one of the yarn feed systems comprises a driven feed roll and a rotatable guide roll arranged in cantilever fashion adjacent each other.

A threading device is provided for placing before the start of the process, a yarn about the circumference of the rolls, with a total looping >360°. The special advantage of the texturing machine according to the invention lies in that at the start of the process, the yarn can be guided largely automatically without the intervention of an operator. By activating the threading device, the yarn can be directly received and threaded in the feed system, or it is possible to engage the yarn already advancing laterally beside the rolls, and to thread it in the feed system. After threading the yarn, preferably in a plurality of loopings, the threading device is deactivated and returned to an idle position.

In an advantageous further development of the texturing machine according to the invention, the threading device comprises at least one movable yarn guide and a guide means that controls the movement of the yarn guide. With that, it becomes possible to receive, engage, or guide the yarn in a reliable manner during the entire threadup procedure. The guide means may be formed, for example, by electric or pneumatic means, which permit a uniform, controlled movement of the yarn guide.

Advantageously, the yarn guide is moved by the guide means in a plane transverse of the longitudinal axes of the rolls along a path encircling the rolls at least in part in the direction of the looping. This ensures that on the one hand the yarn is uniformly placed in a plane of advance against the circumference of the rolls, and that on the other hand the advancing movement of the yarn is supportive during the threadup procedure. In this process, the yarn advances along a guide path, which encircles the two spaced rolls according to the direction of the looping. To this end, it is possible to use both guide means, which move the yarn guide along a continuous guide path about the rolls, or such guide means which guide the yarn guide by a forward and a return movement along a discontinuous guide path.

To engage and thread a yarn advancing beside the rolls before the start of the process, it is preferred to construct the yarn guide as a wire bow. The wire bow connects with its one end to the guide means, so that it can be guided, for example, by pivoting movements.

A preferred further development of the texturing machine according to the invention provides that while moving along its guide path, the wire bow passes through a catching position arranged in the region of the yarn leaving the rolls, which is referred to as the delivery side. From the catching position, the wire bow is moved to a threading position located in region of the yarn advancing toward the rolls, which is referred to as the feed side. With that, it is possible to guide the yarn advancing laterally beside the rolls freely, irrespective of the threading device, before the threading step only upon activation of the threading device is the yarn caught and threaded by the yarn guide.

The particularly preferred further development of the texturing machine with a wire bow as a yarn guide provide the further advantage that the yarn can be threaded only by the movement of a single yarn guide. To this end, the yarn guide has a catching groove, which engages in the catching position, the yarn advancing in the guide plane during the movement of the wire bow, and which places the yarn length advancing toward the wire bow against the circumference of the rolls during the transition to the threading position. To avoid that the yarn length leaving the wire bow is also placed against the circumference of the rolls, a slide edge is provided, which extends from the guide plane to beyond the free face ends of the rolls. This ensures that during the transition from the feed side to the delivery side, the yarn length leaving the yarn guide is guided outside of the looping about the rolls.

According to a further, particularly advantageous feature of the texturing machine according to the invention, the yarn guide may also be formed by an injector tubing, through which the yarn advances, and which connects to the guide means via a support. In addition, this permits extending the threadup procedure, so that after having been placed against the rolls by the threading device, the yarn advances to a subsequent processing unit or to a subsequent feed system.

To control the movement of the yarn guide, the guide means according to an advantageous further embodiment comprises a guide track formed in the machine frame with a sliding block being guided therein. In this arrangement, the guide path of the yarn guide is defined by the shape of the guide track. The yarn guide is made preferably integral with the sliding block. The sliding block connects to a drive, which is controllable for activating the threadup procedure.

However, it is also possible that the yarn guide is adapted for pivoting about an axle by means of a pivot arm. To this end, the pivot axle is arranged on the machine frame preferably between the rolls. The movement of the pivot arm is controlled by a pivot drive arranged on the machine frame.

To be able to thread the yarn even in hard-to-access locations of the machine, an advantageous further development of the texturing machine according to the invention provides for guiding the yarn by means of a plurality of guide tubes each connecting to an injector. In this arrangement, an outlet end of one of the guide tubes is arranged on the feed side, and a suction end of another guide tube on the delivery side. In particular in the case of false twist texturing machines, it is known to thread the yarn via such guide tubes automatically in an aftertreatment zone up to the takeup device. Insofar, this advantageous further development is especially suited for false twist texturing machines.

To ensure that during the threadup of the yarn, the yarn length leaving the yarn guide does not enter the region of the looping about the rolls, the outlet end of one of the guide tubes is arranged relative to the suction end of the other guide tube, laterally of the rolls in such a manner that a yarn path forms, which extends through a plane formed by the face ends of the rolls. In this connection, the outlet end is arranged in the region of the looping about the rolls, and the suction end outside of the region of the looping about the rolls.

The method of the present invention ensures that even when laying a plurality of loopings, the yarn lengths are prevented from intertwining, since the guidance of the yarn on the feed side of the rolls and the guidance of the yarn on the delivery side of the rolls remain unchanged in their positions during the threadup procedure. To this end, the yarn is guided before the start of the threadup procedure, laterally beside the rolls, from the feed side to the opposite delivery side of the rolls. Then, the yarn is caught on the delivery side by a yarn guide, which is moved into the path of the yarn in the direction of the rolls, and guided by the yarn guide at a distance from the rolls to the feed side along a path in the direction of the looping. During the movement of the yarn guide, the yarn length advancing toward the yarn guide is placed against the circumference of the rolls, and the yarn length leaving the yarn guide is guided outside of the looping about the rolls. As soon as the yarn guide reaches the plane of the yarn advancing on the feed side, the yarn will be released from the yarn guide. The yarn length advancing toward the yarn guide loops about the rolls, and then advances from the circumference of the roll arranged on the feed side toward the opposite delivery side.

To lay a plurality of loopings on the rolls, the procedure is repeated several times in accordance with the desired number of loopings.

The method of the present invention is not limited only to feed systems in the region of texturing machines, but may also be easily used in feed systems or draw zones in other areas, wherein two rolls arranged in spaced relationship guide one or more yarns with several loopings.

BRIEF DESCRIPTION OF THE DRAWINGS

In the following, further advantages are described in association with an embodiment of the texturing machine, with reference to the attached drawings, in which.

DETAILED DESCRIPTION OF THE PREFERRED EMBODIMENTS

Figure 1:
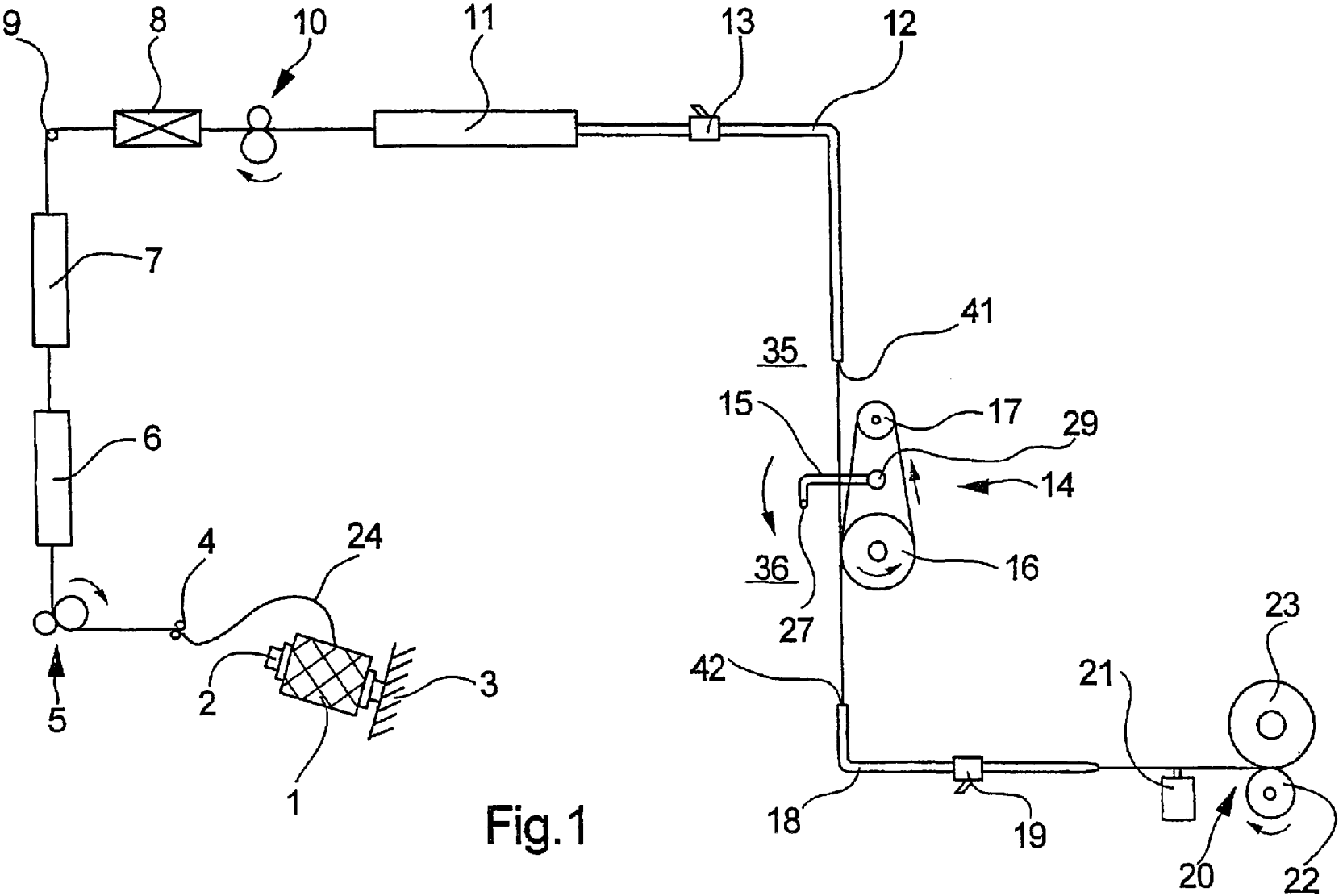
FIG. 1 is a schematic view of an embodiment of a yarn texturing machine according to the invention.

FIG. 1 is a schematic view of a working position of a texturing machine according to the invention. The texturing machine has a plurality of working positions, in each of which a yarn is textured and wound. Thus, each of the working positions is of identical construction, so that in the following the individual processing units of the texturing machine are described with reference to the yarn path of one working position.

In a creel frame 3, a mandrel 2 mounts a feed yarn package 1. The feed yarn package holds a flat thermoplastic yarn 24. A first feed system 5 unwinds the yarn 24 overhead from feed yarn package 1. To this end, a yarn guide 4 is arranged downstream of feed yarn package 1. From the feed system 5, the yarn 24 enters a texturing zone. The texturing zone is formed by a texturing unit 8, a heating device 6, and a cooling device 7. In the present embodiment, the texturing unit 8 is designed and constructed as a false twist unit, so that a false twist produced in the yarn 24 is set within the heating device 6 and cooling device 7. Upstream of texturing unit 8 is a deflection roll 9.

A second feed system 10 withdraws the yarn 24 from the texturing zone, and advances it to an aftertreatment zone. In the aftertreatment zone, a second heating device 11 is provided. Arranged downstream of heating device 11 is a third feed system 14. The feed system 14 is formed by a driven feed roll 16, and a guide roll 17 arranged in spaced relationship therewith. In this feed system, the yarn 24 is guided on the circumference of rolls 16 and 17 by looping thereabout several times.

The feed systems 5 and 10 are realized, for example, as so-called nip-type feed systems, in which the yarn is guided between a driven feed roll and a pressure roll in circumferential contact with the feed roll.

Downstream of feed system 14 is a takeup device 20. The takeup device 20 comprises a pivotally supported package holder (not shown), the free end of which mounts a package 23. The package 23 lies against the circumference of a drive roll 22, which is driven by a drive at a substantially constant circumferential speed. Upstream of the yarn contact with package 23 is a yarn traversing device 21, which reciprocates the yarn within the package width. Such traversing devices may include a traversing yarn guide driven by a cross-spiraled roll or by a belt drive.

In FIG. 1, the processing units and feed systems of the texturing machine are shown in operation. For crimping, the yarn being false twisted in this instance by the texturing unit, is heated inside heating device 6 to a temperature above 150°. Subsequently, the yarn is cooled by cooling device 9 to a temperature of approximately 80°, so that the twist imparted to the yarn is set. For a shrinkage treatment, the yarn advances after being textured, through the second heating device 11, and thereafter in several loopings through feed system 14. The crimped yarn is then wound to package 23.

To thread the yarn 24 in the working position at the beginning of the process, a guide tube 12 with an injector 13 connects to the outlet of the second heating device 11. The guide tube 12 includes an outlet end 41, which is arranged on a feed side 35 of feed system 14. On an opposite delivery side 36 of feed system 14, a suction end 42 of a second guide tube 18 is arranged, which likewise connects to an injector 19. The guide tube 18 ends directly upstream of the takeup device 20.

Associated to feed system 14 is a threading device 15, which is described below in greater detail with reference to FIGS. 2 and 3.

Figure 2:
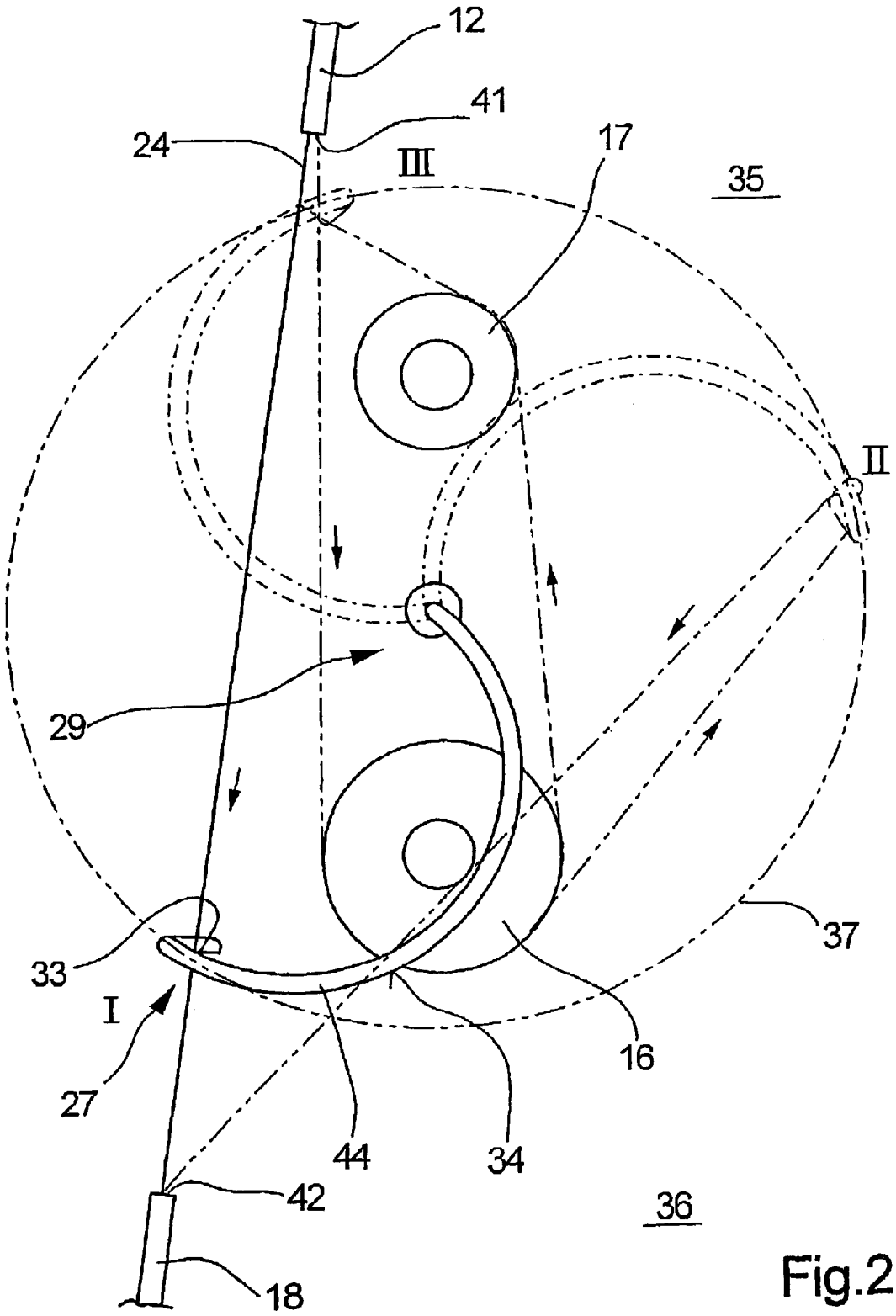
FIG. 2 is a schematic front view of a feed system with a threading device of the texturing machine according to the invention as shown in FIG. 1.
Figure 3:
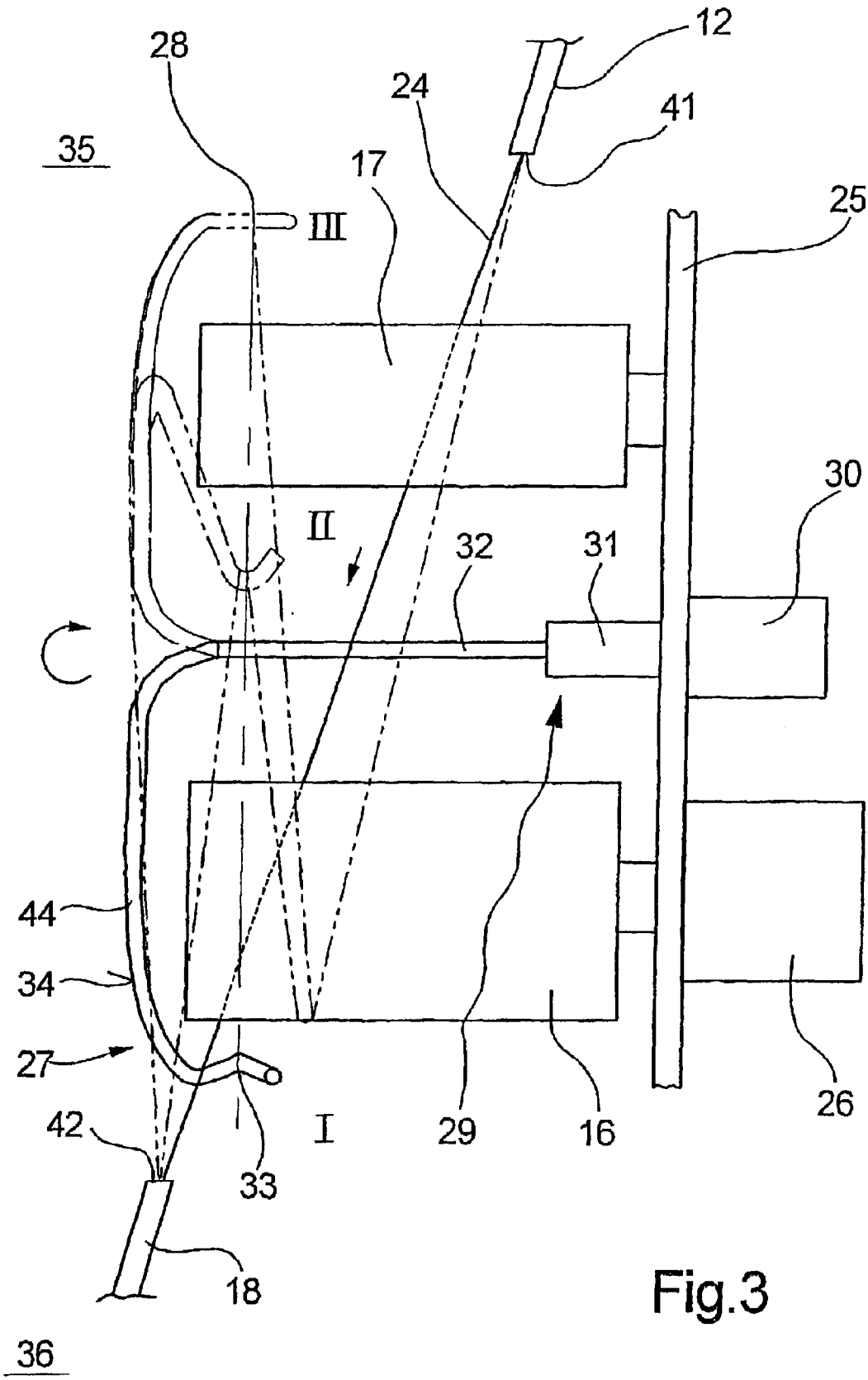
FIG. 3 is a schematic side view of the feed system with the threading device of the texturing machine according to the invention as shown in FIG. 1.

Shown in FIG. 2 is a front view of feed system 14 with threading device 15, and in FIG. 3 a side view of feed system 14 with threading device 15. Unless explicitly specified, the following description will apply to both Figures.

The rolls 16 and 17 of feed system 14 are rotatably mounted in cantilever fashion to a machine frame 25, with the feed roll 16 being connected to a feed roll drive 26.

The threading device 15 comprises a movable yarn guide 27 and a guide means 29 connected thereto. The guide means 29 is formed by a pivot drive 30, a pivot axle 31, and a pivot arm 32. At its free end, the pivot arm 32 is made integral with a wire bow 44 forming the yarn guide 27. The wire bow 44 forms a catching groove 33, as well as slide edge 34, which lies on the side of wire bow 44 opposite to catching groove 33. The guide means 29 moves wire bow 44 along a guide path 37, which encircles the rolls 16 and 17 (FIG. 2). In so doing, the catching groove 33 of wire bow 44 moves in a guide plane 28 (FIG. 3), which extends crosswise to the longitudinal axes of rolls 16 and 17. The guide plane 28 is located in the looping region of rolls 16 and 17. The slide edge 34 formed on wire bow 44 extends from the guide plane 28 into a region outside of the looping about the rolls, with the slide edge 34 passing through the plane formed by the face ends of rolls 16 and 17.

For laying the yarn 24 against the circumference of rolls 16 and 17, the yarn first advances along a threading path between guide tubes 12 and 18 from the feed side 35 to the delivery side 36 of feed system 14 freely on the side next to rolls 16 and 17. The yarn path running in this instance between the guide tubes 12 and 18 extends through the guide plane 28 in the region of the delivery side 36, note FIG. 3. In this phase, the threadup procedure starts by activating the threading device.

In FIGS. 2 and 3, the threadup procedure is shown by several positions of wire bow 44. At the beginning of the threadup procedure, the guide means 29 moves the wire bow to a catching position. In so doing, the catching groove 33 of wire bow 44 engages the yarn 24 on the delivery side 36. In this situation, the position of wire bow 44 is indicated in FIGS. 2 and 3 at I. As the wire bow 44 continues to move, the yarn length advancing from guide tube 12 toward wire bow 44 comes first to lie against the circumference of feed roll 16. The yarn length leaving catching groove 33 for guide tube 18, is guided via the slide edge 34 of wire bow 44. In so doing, the leaving yarn length is removed from the circumference of rolls 16 and 17. In FIGS. 2 and 3, this situation is shown in phantom lines at II by an intermediate position of wire bow 44 during the threadup procedure.

In a threading position, which is identified by III, the catching groove 33 of wire bow 44 is on the feed side 35. In this position, the yarn length advancing from guide tube 12 to catching groove 33 is placed against the circumference of guide roll 17 after looping about feed roll 16. During its continuing movement, the yarn is released from catching groove 33 on the feed side laterally besides rolls 16 and 17. The yarn is now guided with a looping on rolls 16 and 17. From the guide roll 17, the yarn enters suction end 42 of guide tube 18. The wire bow 44 continues to move in the direction of the looping, so that during the continuing movement of wire bow 44, the catching groove 33 engages the yarn again between guide roll 17 and guide tube 18.

Depending on the number of the desired loopings about the rolls 16 and 17, the threadup procedure is repeated several times.

The threading device shown in FIGS. 2 and 3 is exemplary. Thus, the movement of the yarn guide could occur, as described, by rotation or by a guide means, which performs a pivoting movement or a combination between a pivoting movement and a reciprocating movement parallel to the longitudinal axis. Likewise, the construction of yarn guide 27 is exemplary. Thus, it would be possible to guide, for example, the advancing yarn length by a separate yarn guide and the leaving yarn end likewise by a second separate yarn guide. The yarn guides could be moved by guide means jointly or separately.

Figure 4:
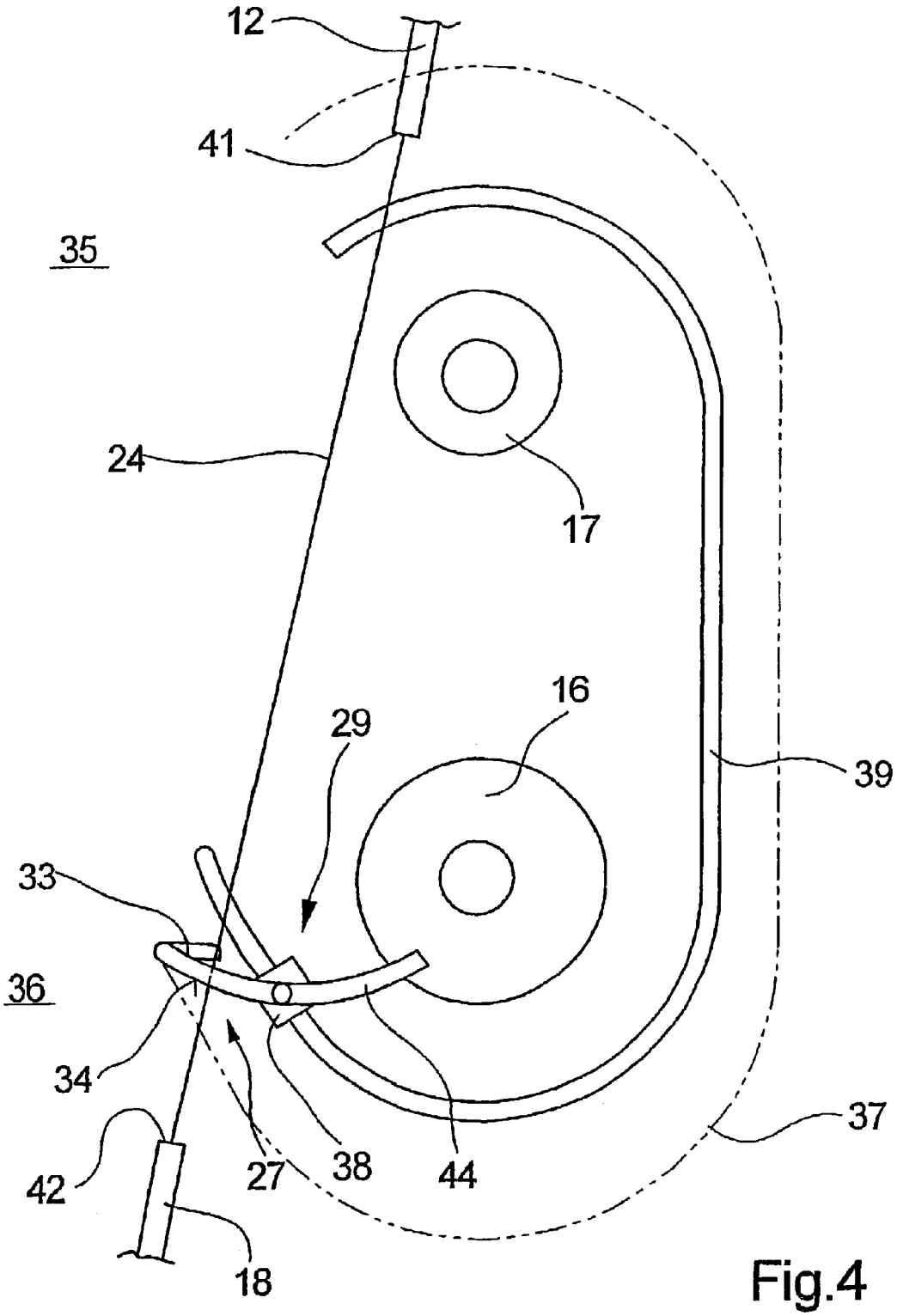
FIG. 4 is a schematic front view of a further embodiment of a threading device.
Figure 5:
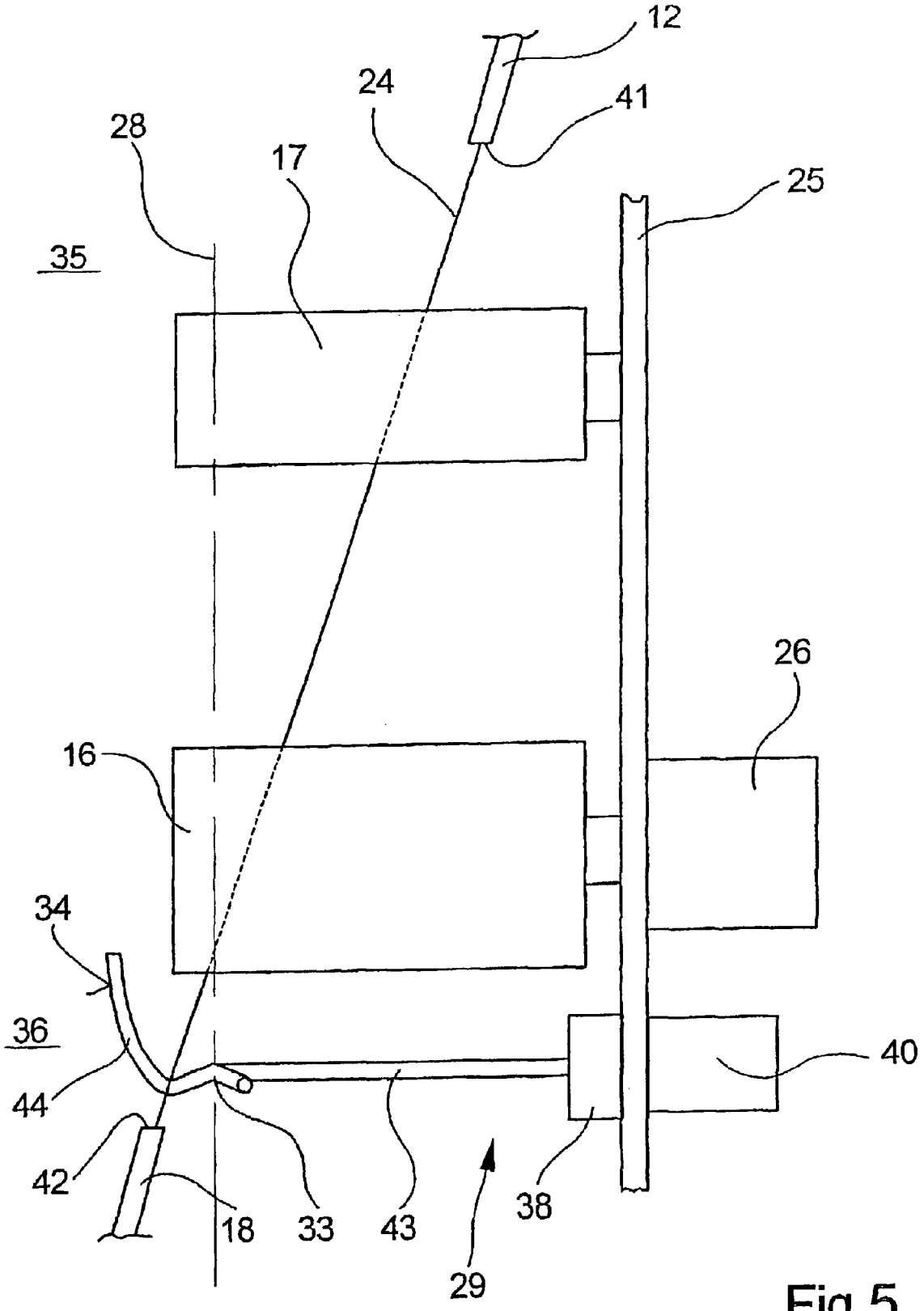
FIG. 5 is a schematic side view of the embodiment of FIG. 4.

FIGS. 4 and 5 show as an example a further threading device. FIG. 4 is a front view and FIG. 5 a side view of the feed system 14 with the embodiment of threading device 15. The feed system 14 is identical with the foregoing embodiment of FIGS. 2 and 3, so that in the following only the differences will be described in greater detail. For performing the movement of yarn guide 27, the guide means 29 is formed by a sliding block drive 40, a guide track 39, and a sliding block 38. To this end, the machine frame includes a guide track 39, which surrounds the rolls 16 and 17 in an angular range >180°. Arranged in the guide track 39 is a sliding block 38. The sliding block 38 is driven in guide track 39 by sliding block drive 40. On the sliding block 38, an arm 43 is provided, which extends substantially parallel to the longitudinal axis of rolls 16 and 17, and mounts at its free end the yarn guide 27. The yarn guide 27 is formed by a wire bow 44. The wire bow 44 includes a catching groove 33, which extends in the guide plane 28 for engaging and threading the yarn 24. Likewise, the wire bow includes a slide edge 34, for guiding during the threadup procedure the yarn length that leaves catching groove 33, outside of the looping about the rolls. For threading the yarn 24, the sliding block drive 40 is activated in such a manner that it guides wire bow 44 along its guide path 37 in the direction of the looping about rolls 16 and 17. After releasing the yarn on the feed side 35, the sliding block drive 40 returns the sliding block 38 in guide track 39, so that the wire bow 44 is moved back to its starting position. In this connection, the slide edge 34 of wire bow 44 is shaped such, that upon crossing the yarn path, the yarn is laterally deflected for the passage of yarn guide 27. Upon reaching the starting position, the yarn can again be threaded for looping about rolls 16 and 17.

Figure 6:
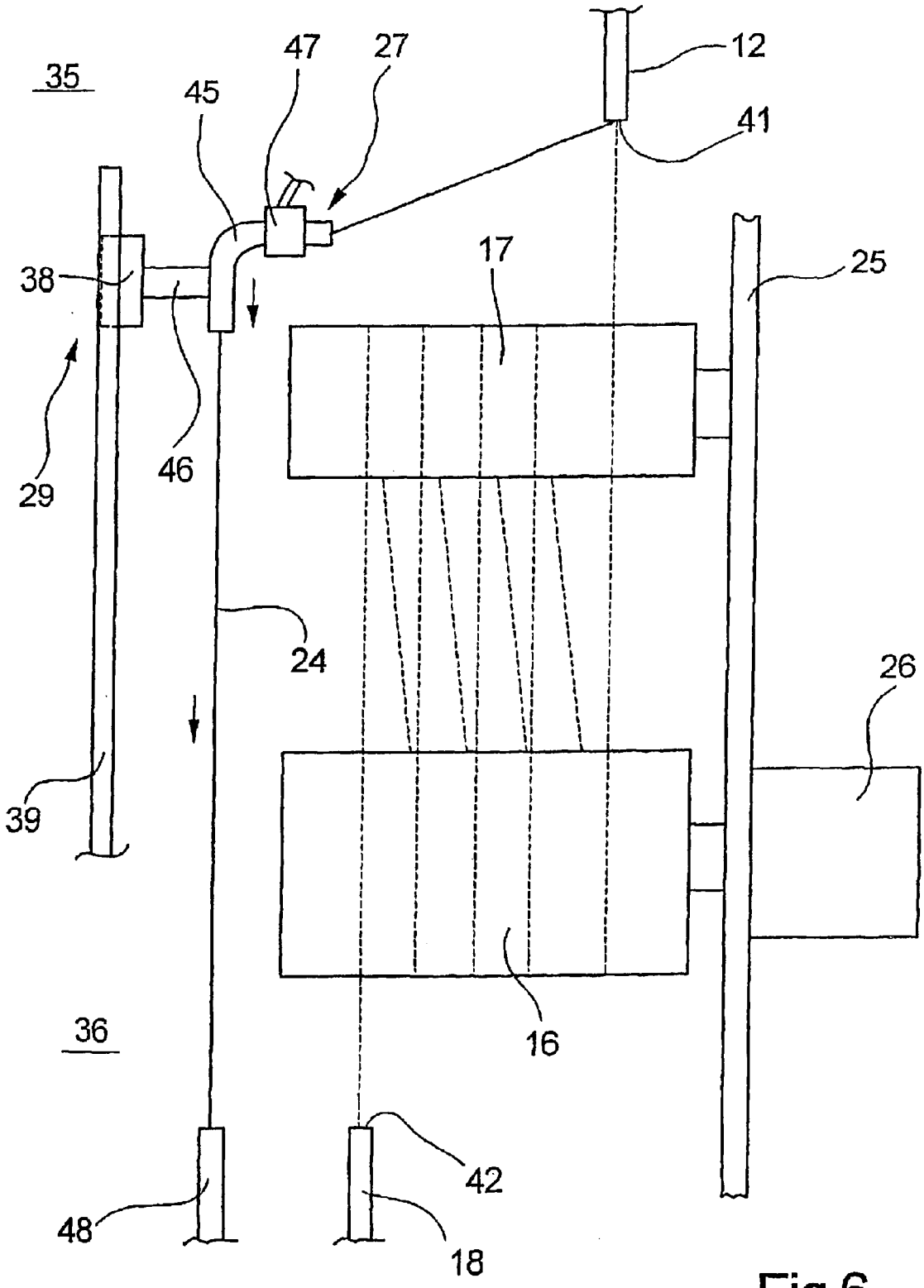
FIG. 6 is a schematic side view of a further embodiment of the threading device.

FIG. 6 is a schematic view of a further embodiment of a threading device for threading a yarn in a feed system, as could be used, for example, in the texturing machine shown in FIG. 1. The feed system consists of guide roll 17 and feed roll 16. The guide roll 17 and feed roll 16 are rotatably mounted in cantilever fashion and spaced relationship to machine frame 25. The feed roll 16 connects to a drive 26. On the feed side 35, a guide tube 12 supplies a yarn 24 to the feed system. In the operating state, which is shown in FIG. 6 in phantom lines, the yarn 24 is guided in several loopings over feed roll 16 and guide roll 17, subsequently received on the delivery side by a second guide tube 18, and guided within the working position to the next processing unit.

For threading the yarn 24 before the start of the process, a threading device comprising a yarn guide 27 and a guide means 29 is arranged upstream of the free end faces of rolls 16 and 17. The yarn guide 27 is formed by an injector tubing 45, in which an injector 47 generates an air current acting upon the guidance of yarn 24. The injector tubing 45 is arranged by means of a support 46 on a sliding block 38. The sliding block 38 is moved in a guide track 39 by a drive not shown. The guide track 39 is constructed preferably as a continuous track, which encircles the rolls 16 and 17. On the delivery side 36, a suction tube 48 is positioned, through which the yarn 24 could be advanced to a waste container not shown.

At the start of the process, the injector tubing 45 is moved to a catching position on the feed side 35, which is not shown. A yarn 24 exiting from the outlet end 41 of guide tube 12 is received in the catching position by injector tubing 45, and subsequently advanced to suction tube 48. Between the suction tube 48 and the injector tubing 45, it would be possible to provide a flexible hose connection. However, in the case of the embodiment shown in FIG. 6, it is also possible to form between the injector tubing 45 and suction tube 48 a free zone, which is bridged by a corresponding air guidance of the yarn 24.

Once the yarn 24 advances in injector tubing 45, the guide means 29 is activated, and the sliding block 38 moves along its predefined guide track 39 in the direction of delivery side 36 and again back. In so doing, the yarn 24 is guided around rolls 16 and 17. Depending on the number of loopings of the yarn 24 about rolls 16 and 17, this step is repeated several times. At the end of the threadup procedure, the tubing 45 is moved to the delivery side 36 directly to the suction opening 42 of guide tube 18. The yarn is then taken in by guide tube 18, so that the threadup procedure is completed.

The embodiments of the threading device shown in FIGS. 2–6 are exemplary. In particular, in the case that the yarn 24 advances laterally besides feed rolls 16 and 17, as shown in FIGS. 2–5, it would be possible to realize the yarn guide by yarn guides from a piece of wire shaped in any desired manner. Thus, for example, the wire piece could include a spiral, the winds of which receive the yarn, so that in a single travel around the rolls, the yarn leaves one wind each of the spiral during each looping The texturing machine of the present invention thus distinguishes itself by a high degree of automation. For example, a plurality of feed systems may each be formed by a feed roll and a guide roll, with a threading device that is optimal for the situation and position of the feed system, being associated to each feed system. A manual intervention in the threadup procedure of the yarn in a texturing machine is not needed or reduced to a minimum.

What is claimed is:

1. A yarn texturing machine comprising a plurality of yarn processing units, a plurality of yarn feed systems for serially advancing a yarn along a path of travel through the processing units, at least one of the yarn feed systems comprising a driven feed roll and a rotatable guide roll arranged in cantilever fashion and adjacent each other on a machine frame so that the advancing yarn may be looped about the rolls with several loopings, a threading device for engaging an advancing yarn as it is guided along the path of travel and then looping the yarn about the circumference of the rolls with a total looping greater than 360°, wherein the threading device comprises at least one movable yarn guide and a guide means controlling the movement of the yarn guide, wherein the guide means is designed and constructed such that the yarn guide is guided in a guide plane transverse of the longitudinal axes of the rolls along a guide path encircling at least in part the rolls in the direction of the looping, and wherein the yarn guide is formed by a wire bow, which connects at one end thereof to the guide means.

2. The yarn texturing machine of claim 1, wherein during its movement in the guide plane, the wire bow travels through a catching position (I) and a threading position (II), that in the catching position (I) for catching the yarn on a delivery side, the wire bow is arranged in the region of the yarn leaving the rolls, and that in the threading position (II) for threading the yarn on a feed side, the wire bow is arranged in the region of the yarn advancing toward the rolls.

3. The yarn texturing machine of claim 2, wherein the wire bow comprises a catching groove which engages during the movement of the wire bow in the catching position, the yarn advancing through the guide plane, and which places during the transition to the threading position, the yarn length advancing toward the wire bow against the circumference of the rolls.

4. The yarn texturing machine of claim 3, wherein the wire bow comprises a slide edge which extends from the guide plane to beyond the free face ends of the rolls, and which guides during the transition from the delivery side to the feed side, the yarn length leaving the wire bow outside of the looping about the rolls.

5. The yarn texturing machine of claim 1, wherein the guide means comprises a pivot arm connected to the yarn guide and a pivot drive arranged on the machine frame, with the pivot arm being adapted for movement about a pivot axle.

6. The yarn texturing machine of claim 1, wherein the yarn feed systems further comprise a plurality of guide tubes, each having an interposed injector for guiding the yarn, with an outlet end of one of the guide tubes being arranged on a feed side upstream of said one yarn feed system, and with a suction end of another guide tube arranged on the delivery side downstream of said one yarn feed system.

7. The yarn texturing machine of claim 6, wherein the outlet end of said one of the guide tubes and the suction end of said another of the guide tubes form a free yarn path, which extends laterally beside the rolls, and which passes through a plane formed by the face ends of the rolls.

8. A method of threading an advancing yarn in a feed system comprising two rolls mounted adjacent each other in cantilever fashion for rotation, and comprising the steps of:

a) guiding the advancing yarn from a feed side of the rolls along a path in a plane which is located laterally beside the rolls to an opposite delivery side of the rolls;

b) catching the yarn by a yarn guide moving into the yarn path, and guiding the yarn by the yarn guide in spaced relationship with the rolls from the delivery side to the feed side along a guide path in a direction of the looping;

c) placing a yarn length advancing toward the yarn guide against the circumference of the rolls during the movement of the yarn guide, and guiding a yarn length leaving the yarn guide outside of the looping about the rolls; and d) releasing the yarn from the yarn guide shortly before or substantially upon reaching said plane of the advancing yarn.

9. The method of claim 8, comprising the further step of repeating steps a) through d) several times to form a plurality of loopings about the rolls.

10. The method of claim 8, wherein said path along which the yarn is guided from the feed side to the delivery side is inclined relative to the longitudinal axis of at least one of the rolls, so that the yarn passes through a plane which is defined by the face ends of the rolls.

11. A yarn texturing machine comprising a plurality of yarn processing units, a plurality of yarn feed systems for serially advancing a yarn along a path of travel through the processing units, at least one of the yarn feed systems comprising a driven feed roll and a rotatable guide roll arranged in cantilever fashion and adjacent each other on a machine frame so that the advancing yarn may be looped about the rolls with several loopings, a threading device for engaging an advancing yarn as it is guided along the path of travel and then looping the yarn about the circumference of the rolls with a total looping greater than 360°, wherein the threading device comprises at least one movable yarn guide and a guide means controlling the movement of the yarn guide, and wherein the yarn guide includes an injector tubing through which the yarn advances, and which connects by means of a support to the guide means.

12. A yarn texturing machine comprising a plurality of yarn processing units, a plurality of yarn feed systems for serially advancing a yarn along a path of travel through the processing units, at least one of the yarn feed systems comprising a driven feed roll and a rotatable guide roll arranged in cantilever fashion and adjacent each other on a machine frame so that the advancing yarn may be looped about the rolls with several loopings, a threading device for engaging an advancing yarn as it is guided along the path of travel and then looping the yarn about the circumference of the rolls with a total looping greater than 360°, wherein the threading device comprises at least one movable yarn guide and a guide means controlling the movement of the yarn guide, and wherein the guide means comprises a sliding block connected to the yarn guide and a sliding block drive arranged on the machine frame, with the sliding block being guided in a guide track.

13. A yarn texturing machine comprising a plurality of yarn processing units, a plurality of yarn feed systems for serially advancing a yarn along a path of travel through the processing units, at least one of the yarn feed systems comprising a driven feed roll and a rotatable guide roll arranged in cantilever fashion and adjacent each other on a machine frame so that the advancing yarn may be looped about the rolls with several loopings, a threading device for engaging an advancing yarn as it is guided along the path of travel and then looping the yarn about the circumference of the rolls with a total looping greater than 360°, wherein the threading device comprises at least one movable yarn guide and a guide means controlling the movement of the yarn guide, and wherein the yarn feed systems further comprise a plurality of guide tubes, each having an interposed injector for guiding the yarn, with an outlet end of one of the guide tubes being arranged on a feed side upstream of said one yarn feed system, and with a suction end of another guide tube arranged on the delivery side downstream of said one yarn feed system.

14. The yarn texturing machine of claim 13, wherein the outlet end of said one of the guide tubes and the suction end of said another of the guide tubes form a free yarn path, which extends laterally beside the rolls, and which passes through a plane formed by the face ends of the rolls.

15. A yarn texturing machine comprising a plurality of yarn processing units, a plurality of yarn feed systems for serially advancing a yarn along a path of travel through the processing units, at least one of the yarn feed systems comprising a driven feed roll and a rotatable guide roll arranged in cantilever fashion and adjacent each other on a machine frame so that the advancing yarn may be looped about the rolls with several loopings, yarn guide members positioned respectively upstream and downstream of the at least one yarn feed system for initially guiding the advancing yarn laterally beside the rolls of the one yarn feed system, and a threading device for engaging an advancing yarn as it is guided along the path of travel laterally beside the rolls and then looping the yarn about the circumference of the rolls with a total looping greater than 360°.

16. The yarn texturing machine of claim 15 wherein the upstream yarn guide member includes an upstream guide tube having an outlet end which opens on a feed side of said one yarn feed system and an air injector for advancing the yarn therethrough, and wherein the downstream yarn guide member includes a downstream guide tube having an inlet end which opens on a delivery side of said one yarn feed system and which is spaced from the outlet end of the upstream guide tube to form a free yarn path therebetween which extends laterally beside the rolls, and with the downstream guide tube including an air injector for advancing the yarn into the inlet end and through the downstream guide tube.

17. The yarn texturing machine of claim 16 wherein the threading device is positioned and configured to engage the advancing yarn along said free yarn path.

* * * * *